US005529845A

United States Patent [19]

Branchesi et al.

[11] Patent Number: 5,529,845

[45] Date of Patent: Jun. 25, 1996

[54] FIBERS SUITABLE FOR THE PRODUCTION OF NONWOVEN FABRICS HAVING IMPROVED STRENGTH AND SOFTNESS CHARACTERISTICS

[75] Inventors: Millo Branchesi; Leonardo Spagnoli; Giancarlo Braca, all of Terni, Italy

[73] Assignee: Montell North America Inc., Wilmington, Del.

[21] Appl. No.: 259,316

[22] Filed: Jun. 13, 1994

[51] Int. Cl.[6] ..... D02G 3/00

[52] U.S. Cl. ..... 428/359; 428/296; 428/212; 428/286; 428/364; 428/370; 428/401; 428/394

[58] Field of Search ..... 428/288, 296, 428/357, 365, 397, 401, 364, 212, 370, 286, 340; 156/148, 178, 308.2, 86, 181, 167; 264/210.7, 210.8, 210.2, 171, 524, 268

[56] References Cited

U.S. PATENT DOCUMENTS

| | | | |
|---|---|---|---|
| 4,469,540 | 9/1984 | Furukawa et al. | 156/62.4 |
| 4,496,508 | 1/1985 | Hartmann et al. . | |
| 4,770,925 | 9/1988 | Uchikawa et al. | 428/219 |
| 4,874,666 | 10/1989 | Kubo et al. | 428/398 |
| 5,078,935 | 1/1992 | Kobayshi et al. | 264/103 |
| 5,227,224 | 7/1993 | Ishikawa et al. | 428/212 |

FOREIGN PATENT DOCUMENTS

| | | |
|---|---|---|
| 552810 | 1/1993 | European Pat. Off. . |
| 391438 | 10/1993 | European Pat. Off. . |
| 598224A | 5/1994 | European Pat. Off. . |
| 9321371 | 10/1993 | WIPO . |

OTHER PUBLICATIONS

U.S. Ser. No. 07/968,766, filed Oct. 30, 1992.
U.S. Ser. No. 08/259,317, filed Jun. 13, 1994.
U.S. Ser. No. 08/259,318, filed Jun. 13, 1994.

*Primary Examiner*—Patrick J. Ryan
*Assistant Examiner*—Merrick Dixon

[57] ABSTRACT

Disclosed is a simple, undrawn, 1–10 dtex, propylene polymer fiber, the thermowelding stength of which is at least 5 Newtons, the flexibility index of which is greater than 800, and which has good resistance to yellowing and aging. Also disclosed are a nonwoven fabric of said fiber, and a process of making the fiber.

7 Claims, No Drawings

FIBERS SUITABLE FOR THE PRODUCTION OF NONWOVEN FABRICS HAVING IMPROVED STRENGTH AND SOFTNESS CHARACTERISTICS

The present invention relates to polyolefin fibers suitable for the production of nonwoven fabrics by spun-bonding process, having improved strength and softness characteristics. The present invention also relates to a process for the production of said fibers, a process to produce nonwoven fabrics by spun-bonding using said fibers, and the nonwoven fabrics obtained by said process.

The definition of "fibers" includes also products similar to fibers, such as fibrils.

Nonwoven fabrics are widely used in various applications. They are used, for example, in the preparation of articles to be utilized in the agricultural field, and for domestic and industrial "throwaway" articles. For some specific uses said fabrics must possess good softness characteristics (which depend on the flexibility index of the fiber), strength (which depends on the thermowelding strength of the fiber) and resistance to yellowing. These characteristics are particularly important in the health and medical fields.

Polyolefin fibers which can be used for the preparation of nonwoven fibers possessing good aging and yellowing resistance are already known in the art. For example, fibers with the above mentioned properties are described in published European patent application EP-A-391438. Said patent application describes some combinations of stabilizers which can render the fibers particularly resistant to yellowing and aging.

U.S. patent application Ser. No. 07/968,766, now U.S. Pat. No. 5,346,756, describes nonwoven fabrics which have, among other things, good softness and strength properties (in the examples the maximum thermowelding strength of the fibers constituting the fabrics is slightly higher than 3 Newtons).

Now some polyolefin fibers have been found which possess a high flexibility index and/or thermowelding strength, besides presenting good yellowing and aging resistance. These properties allow one to obtain nonwoven fabrics which offer good softness and strength.

One embodiment of the present invention is a process for the preparation of nonwoven fabrics which comprise said fibers and present both softness and strength properties.

Another embodiment of the present invention is a process used to prepare said fibers.

Yet another embodiment of the present invention relates to the nonwoven fabrics obtained with said process.

Accordingly the present invention provides a noncomposite, undrawn fiber for nonwoven fabrics having thermowelding strength equal to or greater than 5 Newtons and/or flexibility higher than 800, comprising a polymer material additivated with organic phosphites and/or phosphonites, HALS (hindered amine light stabilizers) and optionally phenolic antioxidants, said polymer material being selected from:

1) isotactic propylene homopolymers having an isotactic index greater than 90;
2) random copolymers of propylene with ethylene and/or a $C_4$–$C_8$ α-olefin; and
3) blends of homopolymers 1) with copolymers 2) , or blends of at least one of the above mentioned homopolymers and copolymers with heterophasic propylene polymers, said heterophasic polymers comprising (by weight):

A) from 10 to 60 parts of a propylene homopolymer, or a copolymer of propylene with ethylene and/or a $C_4$–$C_8$ α-olefin, containing over 80% of propylene and having an isotactic index greater than 80 (Fraction A);

B) from 1 to 25 parts of an essentially linear semicrystalline copolymer of ethylene with a $C_3$–$C_8$ α-olefin, insoluble in xylene at ambient temperature (Fraction B); and C) from 15 to 87 parts of a copolymer fraction of ethylene with propylene and/or a $C_4$–$C_8$ α-olefin, and optionally minor quantity of diene, said copolymer fraction containing from 10 to 80% of ethylene and being soluble in xylene at ambient temperature (Fraction C).;

said fiber being obtained by a spinning process operating with a real or equivalent output hole diameter of less than 0.5 mm, with a hole flow-rate ranging from 0.1 to 0.6 g/minute and at a spinning temperature ranging from 260° C. to 320° C., using polymers (1) or (2), or polymer blends (3), having MFR from 5 to 40 g/10 min, and in the absence of a drawing step.

The $C_4$–$C_8$ α-olefins to be used for the preparation of the copolymers which can be present in random copolymers 2), Fraction A and Fraction C are linear or branched alkenes, and are preferably selected from the following compounds: 1-butene, 1-pentene, 1-hexene, 1-octene and 4-methyl-1-pentene. 1-Butene is the preferred α-olefin.

The random copolymers 2) contain a quantity of comonomer ranging from 0.05 to 20% by weight. When the quantity of comonomer exceeds 5%, said copolymers must be blended with the propylene homopolymer.

Preferably Fraction A is present in the heterophasic polymer in quantities ranging from 10 to 50 parts by weight, and is made up of a propylene homopolymer with an isotactic index preferably greater than 90, more preferably from 95 to 98, or of the copolymer defined above, preferably containing over 85%, more preferably from 90 to 99% of propylene.

Preferably Fraction B is present in the heterophasic polymer in quantities ranging from 7 to 15 parts by weight and has a crystallinity ranging from about 20 to 60%, determined by way of DSC (Differential Scanning Calorimetry). The copolymer of said fraction is preferably selected from the following types of copolymers: ethylene/propylene, containing over 55% of ethylene; ethylene/propylene/$C_4$–$C_8$ α-olefin, containing from 1 to 10% of said α-olefin and from 55% to 98%, preferably from 80 to 95%, of ethylene plus said α-olefin; ethylene/$C_4$–$C_8$ α-olefin, containing from 55% to 98%, preferably from 80 to 95%, of said α-olefin.

Preferably Fraction C is present in the heterophasic polymer in quantities ranging from 30 to 75 parts by weight, and is made up of a copolymer selected from: an ethylene/propylene copolymer containing from 15% to 70% of ethylene, preferably from 20 to 60%; an ethylene/propylene/$C_4$–$C_8$ α-olefin copolymer, containing from 1 to 10% of said α-olefin, preferably from 1 to 5%, wherein the total quantity of ethylene plus α-olefin ranges from 20 to less than 40%; and an ethylene/α-olefin copolymer, containing from 20 to less than 40%, preferably from 20 to 38%, more preferably from 25 to 38%, of said α-olefin. The dienes, optionally present in the copolymers of said Fraction are present in quantities equal to or less than 10%, and are preferably selected from: butadiene, 1,4-hexadiene, 1,5-hexadiene and 2-ethylidene-5-norbornene.

The heterophasic propylene polymers are prepared either by mechanically blending components (A), (B), and (C) in the molten state, or by using a sequential polymerization process carried out in one or more steps, and using highly stereospecific Ziegler-Natta catalysts.

Examples of the heterophasic polypropylene compositions mentioned above, as well as the catalysts and polymerization processes commonly used for their preparation, are described in published European patent applications 400333 and 472946.

The blends 3) are obtained by melting and pelletizing the polymers, or by blending them without melting. In these blends, the quantity of heterophasic polymer and/or random copolymer 2) containing over 5% of comonomer preferably does not exceed 30% of the total weight of the blend.

The stabilizers which are added to the polyolefins described above are the following:

a) one or more organic phosphite and/or phosphonites, preferably in quantities ranging from 0.01 to 0.5% by weight, more preferably from 0.02 to 0.15%;

b) one or more HALS (Hindered Amine Light Stabilizers), preferably in quantities ranging from 0.005 to 0.5% by weight, more preferably from 0.01 to 0.025;

c) optionally one or more phenolic oxidants, preferably in concentrations not exceeding 0.02% by weight.

The following compounds are examples of phosphites that can be used as additives for the polyolefins of the fibers of the present invention:

tris(2,4-di-tert-butylphenyl)phosphite, marketed by CIBA GEIGY under the trademark Irgafos 168; distearyl pentaerythritol diphosphite, marketed by BORG-WARNER CHEMICAL under the trademark Weston 618; 4,4'-butylidenebis(3-methyl-6-tert-butylphenyl-di-tridecyl)phosphite, marketed by ADEKA ARGUS CHEMICAL under the trademark Mark P; tris (monononyl phenyl)phosphite; bis(2,4-di-tert-butyl)pentaerythritol diphosphite, marketed by BORG-WARNER CHEMICAL under the trademark Ultranox 626.

The preferred organic phosphonite that can be used as additive for the polyolefins of the fibers of the present invention is tetrakis(2,4-di-tert-butylphenyl)4,4-diphenylene diphosphonite, marketed by SANDOZ under the trademark Sandostab P-EPQ.

Examples of HALS that can be added to the polyolefins of the fibers of the present invention are:

poly{[6-(1,1,3,3,-tetramethylbutyl)-imine]-1,3,5-triazine-2,4-diol] [2-(tetramethylpiperidyl)amine]hexamethylene-[4-(2,2,6,6-tetramethylpiperidyl)imine} (Chimassorb 944), Chimassorb 905, bis(2,2,6,6,-tetramethyl-4-piperidyl)sebacate (Tinuvin 770), Tinuvin 992, poly(N-β-hydroxymethyl-2,2,6,6,-tetramethyl-4-hydroxy-piperidyl succinate (Tinuvin 622), Tinuvin 144, Spinuvex A36, marketed by CIBA-GEIGY; Cyasorb UV3346 marketed by AMERICAN CYANAMIDE.

Examples of preferred phenolic antioxidants to be used as additives in the polyolefins making up the fibers of the present invention are: tris(4-t-butyl-3-hydroxy-2,6-dimethylbenzyl)-s-triazine-2-4-6 -(1H,3H,5H)-trione, sold by AMERICAN CYANAMID under the Cyanox 1790 trademark; calcium bi[monoethyl(3,5-di-tert-butyl-4-hydroxybenzyl)phosphonate]; 1,3,5-tris (3,5-di-tert-butyl-4-hydroxybenzyl)-s-triazine-2,4,6(1H,3H,5H)trione; 1,3,5-trimethyl-2,4,6-tris (3,5-di-tert-butyl-4-hydroxybenzyl)benzene; pentaerythrityltetrakis[3-(3,5-di-tert-butyl-4-hydroxy-phenyl)propionate], sold by CIBA-GEIGY under the following trademarks: Irganox 1425, Irganox 3114; Irganox 1330; Irganox 1010; 2,6-dimethyl-3-hydroxy-4-tert-butyl benzyl abietate.

Besides the above mentioned stabilizers, one can add to the olefins which are consequently converted into the fibers of the present invention, the usual additives, such as pigments, opacifiers, fillers, UV stabilizers, and flame retardants.

The polymers (containing the necessary additives) which are converted in fibers according to the present invention have a melt flow rate (MFR) ranging from 5 to 40 g/10 min. In particular, the polymers of subparagraphs 1) and 2) above have a MFR preferably ranging from 5 to 25 g/10 min. The MFR is measured according to ASTM D 1238, condition L. High MFR values are obtained directly in polymerization, or by controlled radical visbreaking.

The process of controlled radical visbreaking is carried out using, for example, some organic peroxides, such as 2,5-dimethyl-2,5-di(tert-butylperoxy)hexane, during the pelletizing phase or directly in the fiber extrusion step.

The molecular weight distribution of the polymers making up the fibers of the present invention, expressed as $\overline{Mw}/\overline{Mn}$, ranges from 3 to 6, preferably from 3.5 to 4.5.

The polymers to be converted into the fibers of the present invention can be in the form of pellets or nonextruded particles, such as flakes, or spheroidal particles with a diameter ranging from 0.5 to 4.5 mm. Said particles are covered or impregnated, at least on the surface, with the stabilizers (or additives in general) mentioned above, and/or peroxides, if the latter should be necessary to obtain a molecular weight distribution within the range mentioned above.

Additives such as opacifiers, fillers and pigments can also be added while the fiber is being spun.

In order to obtain fibers which present both a high flexibility index (which is important to ensure nonwoven fabrics with good softness characteristics) and a high thermowelding strength (which is important to ensure nonwoven fabrics with good strength characteristics), the spinning process must be carried out preferably at a die temperature ranging from 280° C. to 320° C., and a hole flow-rate from 0.25 to 0.4 g/min/hole for polymers (1) and (2) having MFR ranging from 5 to 25 g/10 min., or it can be carried out preferably at a die temperature ranging from 260° C. to 320° C. and a hole flow-rate from 0.25 to 0.4 g/min/hole for polymer blends (3) having a MFR ranging from 5 to 40 g/10 min. The fibers thus obtained have a flexibility index higher than 800 and a thermowelding strength not lower than 5N.

As previously mentioned, the process for the production of the fibers is also an embodiment of the present invention. The process for the preparation of fibers according to the present invention is carried out by using extruders equipped with a die and without subjecting the fibers to a subsequent drawing. The die is characterized by a real or equivalent output hole diameter of than 0.5 mm. By "output diameter of the holes" is meant the diameter of the holes measured at the external surface of the die, i.e. on the front face of the die from which the fibers exit. Inside the thickness of the die, the diameter of the holes can be different from the one at the output. Moreover, the "equivalent output diameter" definition applies to those cases where the hole shape is not circular. In these cases, for the purposes of the present invention one considers the diameter of an ideal circle having one area equal to the area of the output hole, which corresponds to the above mentioned equivalent diameter. The temperature of both the extruder and the die during the processing of the polymers ranges from 260° C. to 320° C.; in particular it is best to operate at temperatures ranging from 280° C. to 320° C. when the fibers are obtained from polymers (1) and (2), while when using the polymer blends (3) the temperatures can range from 260° C. to 320° C.

The dimensions of the fibers of the present invention if they are to be used for the preparation of nonwoven fabrics, have a count ranging from 1 to 10 dtex. In order to obtain said count, the hole flow-rate must range from 0.1 to 0.6 g/min/hole, preferably from 0.25 to 0.45 g/min/hole.

Tests were carried out on the polymer material and the fibers of the present invention to evaluate their characteristics and properties; the methods used for said tests are described below.

| | |
|---|---|
| Melt Flow Rate (MFR): according to ASTM-D 1238, condition L. | |
| Weight average molecular weight ($\bar{M}w$): | GPC (Gel Permeation Chromatography) in ortho-dichlorobenzol at 150° C. |
| Number average molecular weight ($\bar{M}n$): | GPC (Gel Permeation Chromatography) in ortho-dichlorobenzol at 150° C. |
| Thermowelding strength: in order to evaluate the thermoweldability of staple fibers, one manufactures a nonwoven fabric with the test fiber by way of calendering under set conditions. Then one measures the strength needed to tear said nonwoven fabric when the stress is applied in directions which are both parallel and transverse to that of the calendering. | |

The thermoweldability index (ITS) is defined as follows:

$$ITS=(TM \bullet TC)^{1/2}$$

where TM and TC represent the tear strengths of the nonwoven fabric, measured according to ASTM 1682, for the parallel and transverse directions respectively, and expressed in N.

The value of the strength determined in this fashion is considered a measure of the capability of the fibers to be thermowelded.

The result obtained, however, is influenced substantially by the characteristics regarding the finishing of the fibers (crimping, surface finishing, thermosetting, etc.), and the conditions under which the card web fed to the calender is prepared. To avoid these inconveniences and obtain a more direct evaluation of the thermoweldability characteristics of the fibers, a method has been perfected which will be described below in detail.

Some specimens were prepared from a 400 tex roving (method ASTM D 1577-7) 0.4 meter long, made up of continuous fibers.

After the roving was twisted eighty times, the two extremities were united, thus obtaining a product where the two halves of the roving are entwined as in a rope. On said specimen one produced one or more thermowelded areas by means of a thermowelding machine commonly used in a laboratory to test the thermoweldability of film.

A dynamometer was used to measure the average strength required to separate the two halves of the roving at each thermowelded area. The result, expressed in Newtons or N, was obtained by averaging out at least eight measurements. The welding machine used was the Brugger HSC-ETK. The clamping force of the welding plates was 800N; the clamping time was 1 second; and the temperature of the plates was 150° C.

Flexibility Index

The flexibility of the filaments is represented by an index defined in the following manner:

$$IF=(1/W) \bullet 100$$

where W is the minimum quantity in grams of a twisted roving specimen which when tested with the Clarks Softness-Stiffness Tester changes the direction of the flexion when the plane, on which the specimen is fixed in a perpendicular position, rotates alternatively ±45° with respect to the horizontal plane.

The specimen has the same characteristics as the one used to measure thermowelding strength and is prepared using the same process described above.

Resistance to Yellowing

Norm ISO/TC 38/SC1 at 60° C. was applied to measure the resistance of the fibers to fading caused by gases produced by hydrocarbon combustion. In particular, the resistance to yellowing value referred to in the examples concerns the variation caused by gas fading measured at 60° C. after 4 cycles.

Filaments' Count

Measured according to ASTM D 1577-79.

The following examples are given in order to illustrate and not limit the present invention.

EXAMPLE 1

10 Kg of polypropylene pellets having an isotactic index of 96.5 (calculated as residue insoluble in xylene at 25° C.), MFR of 35 g/10 min., and containing 1000 ppm of the phosphite Irgafos 168 and 200 ppm of the HALS Chimassorb 944, have been prepared by extrusion at 220° C. The peroxide Lupersol 101 (marketed by Lucidol, Pennwalt Corp., U.S.A.) has been used to visbreak the polypropylene to a $\bar{M}w/\bar{M}n$ of 4.2. The polypropylene pellets are spun using a spinning apparatus having the following characteristics:

extruder equipped with a screw having a 25 mm diameter, a length/diameter ratio of 25 and a capacity from 1 to 6 Kg/h;

die with 40 holes, said holes having a diameter of 0.4 mm and a length/diameter ratio of 5;

metering pump;

air quenching system at temperature from 18° to 20° C.;

mechanical winding device with a velocity of up to 600 m/min, or air jet.

The spinning conditions and characteristics of the filaments obtained in this manner are shown in Table 1.

EXAMPLE 2

Flake polypropylene, having a MFR of 2 g/10 min. and additivated with the same additives listed in Example 1, is visbroken with Lupersol until it reaches a MFR of 12 g/10 min, and a $\bar{M}w/\bar{M}n$ of 4. 10 kg of said polymer are then subjected to spinning in the spinning apparatus described in Example 1.

The spinning conditions and characteristics of the filaments obtained in this manner are shown in Table 1.

EXAMPLE 3

A polymer blend comprising: 90 parts by weight of polypropylene having a MFR of 5 g/10 min., and 10 parts by weight of heterophasic polymer having a MFR of 5 g/10 min, intrinsic viscosity of 2.6 dl/g, and the following composition: 55% by weight of ethylene/propylene random copolymer (containing 2.5% of ethylene), and 45% by weight of ethylene/propylene rubber at a 60/40 ratio.

The polymer blend, additivated with the same additives of Example 1 and visbroken with Lupersol 101 until a MFR of 35 g/10 min. is reached, is subjected to spinning, under the conditions listed in Table 1, in the spinning apparatus described in Example 1.

The properties of the fibers obtained are reported in Table 1.

COMPARATIVE EXAMPLE 1 (1c)

10 kg of polypropylene polymer flakes with an isotactic index of 96.5, MFR of 5 g/10 min. , and $\overline{Mw}/\overline{Mn}$ of 6, additivated with the same stabilizers as in Example 1, in the same quantities shown therein, and visbroken with Lupersol 101 in such quantity as to visbreak the polymer to a MFR of 35 g/10 min ($\overline{Mw}/\overline{Mn}$ equal to 3.8), are extruded at 220° C. The pellets obtained have been spun in a spinning apparatus having the same characteristics described in Example 1.

The spinning conditions and properties of the fiber obtained are shown in Table 1.

TABLE 1

| Ex. | Spinning Temperature °C. | Hole flow-rate g/min | Filaments' count dtex | Thermowelding strength at 150° C. N | Flexibility index | Resistance to yellowing gray scale |
|---|---|---|---|---|---|---|
| 1 | 260 | 0.3 | 2.5 | 4.0 | 850 | 4.0 |
| 2 | 300 | 0.3 | 2.5 | 8.0 | 850 | 4.0 |
| 3 | 295 | 0.3 | 2.5 | 6.0[a)] | 1100 | 4.0 |
| 1C | 260 | 0.8 | 2.5 | 2.5 | 800 | 4.0 |

[a)]The test was conducted at 140° C.

Other features, advantages and embodiments of the invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

We claim:

1. A noncomposite, undrawn, 1–10 dtex, polyolefin fiber suitable for nonwoven fabrics, the thermowelding stength of said fiber being at least 5 Newtons, the flexibility index thereof being greater than 800, and which has good resistance to yellowing and aging, the composition of said fiber comprising polymer material stabilized with at least one member of the group consisting of organic phosphites and phosphonites, at least one member of the group consisting of hindered amine light stabilizers, and optionally at least one phenolic antioxidant, said polymer material being selected, subject to the following provisos, from the group consisting of (all parts and %s being by weight):

1) an isotactic, propylene homopolymer having an isotactic index greater than 90;

2) a random copolymer of propylene and an olefin selected from the group consisting of ethylene and $C_4$–$C_8$ α-olefins, the quantity of said olefin being 0.05 to 20% of the copolymer; and 3) a heterophasic polymer comprising:

A) 10 to 60 parts of a propylene polymer selected from the group consisting of propylene homopolymer having an isotactic index greater than 80, and a copolymer of propylene and an olefin selected from the group consisting of ethylene and $C_4$–$C_8$ α-olefins, said copolymer containing over 80% of propylene, and having an isotactic index greater than 80;

B) 1 to 25 parts of an essentially linear semicrystalline polymer of ethylene and a $C_3$–$C_8$ α-olefin, said polymer containing over 55% ethylene, and said polymer being insoluble in xylene at ambient temperature; and C) 15 to 87 parts of a polymer of ethylene, at least one of propylene and a $C_4$–$C_8$ α-olefin, and optionally up to 10% of diene, said polymer containing 10 to 80% of ethylene, and being soluble in xylene at ambient temperature;

provided that when one of said heterophasic polymer, said random copolymer having said olefin in excess of 5%, and a combination of said heterophasic polymer and said random copolymer having said olefin in excess of 5% is selected, the polymer material includes it and material selected from the polymers of 1) and 2), and it does not exceed 30% of the polymer material, further provided that when said random copolymer having said olefin in excess of 5% is selected, said polymer material includes said isotactic, propylene homopolymer, and still further provided that the MFR of said polymer material is 5 to 40 g/10 min, and the $\overline{Mw}/\overline{Mn}$ of said polymer material is from 3 to 6, said fiber having been obtained by extruding said composition at a temperature of 260°–320° C. from a hole in a die, the real or equivalent output diameter of the hole being less than 0.5 mm, and the flow-rate from the hole being 0.1 to 0.6 g/minute, thereby forming a noncomposite fiber, and, without drawing the fiber, cooling and collecting it.

2. The fiber of claim 1, wherein the polymer material is material selected from the group consisting of 1) and 2), the MFR of said polymer material is 5–25 g/10 min, said temperature is 280°–320° C., and said flow-rate from the hole is 0.25 to 0.4 g/min.

3. The fiber of claim 1, wherein the polymer material comprises said heterophasic polymer, the MFR of the polymer material is 5–40 g/10 min, said temperature is 260°–320° C., and said flow rate from the hole is 0.25 to 0.4 g/min.

4. The fiber of claim 1, wherein said polymer material comprises a 1) homopolymer and one of a 3) heterophasic polymer and a 2) random propylene copolymer containing more than 5% of said olefin, the concentration of said one of said heterophasic polymer and said random propylene copolymer being more than 30% of the blend.

5. The fiber of claim 1, wherein said composition contains 0.01 to 0.5% by weight of material selected from the group consisting of organic phosphites and phosphonites, 0.005 to 0.5% by weight of material selected from the group consisting of hindered amine light stabilizers, and 0–0.002% by weight of material selected from the group consisting of phenolic antioxidants.

6. Nonwoven, spun-bonded fabric composed of fibers according to claim 1.

7. A process for producing a noncomposite, undrawn, 1–10 dtex, polyolefin fiber suitable for nonwoven fabrics, the thermowelding strength of said fiber being at least 5 Newtons, the flexibility index thereof being greater than 800, and having good resistance to yellowing and aging, which process comprises: extruding a polymer composition from a hole in a die, the real or equivalent diameter of the hole at its output end being less than 0.5 mm, at a hole output flow-rate of 0.1 to 0.6 g/min, and at a temperature of 260° C. to 320° C., thereby forming a noncomposite fiber, and, without drawing the fiber, cooling and collecting it, said composition comprising polymer material stabilized with at least one member of the group of organic phosphites and phosphonites, at least one member of the group of hindered amine light stabilizers, and optionally at least one phenolic antioxidant, said polymer material being selected, subject to the following provisos, from the group consisting of (all parts and %s being by weight):

1) an isotactic, propylene homopolymer having an isotactic index greater than 90;

2) a random copolymer of propylene and an olefin selected from the group consisting of ethylene and $C_4$–$C_8$ α-olefins, the quantity of said olefin being 0.05 to 20% of the copolymer; and 3) a heterophasic polymer comprising:

A) 10 to 60 parts of a propylene polymer selected from the group consisting of propylene homopolymer having an isotactic index greater than 80, and a copolymer of propylene and an olefin selected from the group consisting of ethylene and $C_4$–$C_8$ α-olefins, said copolymer containing over 80% of propylene, and having an isotactic index greater than 80;

B) 1 to 25 parts of an essentially linear semicrystalline polymer of ethylene and a $C_3$–$C_8$ α-olefin, said polymer containing over 55% of ethylene, and being insoluble in xylene at ambient temperature; and C) 15 to 87 parts of a polymer of ethylene, at least one of propylene and a $C_4$–$C_8$ α-olefin, and optionally up to 10% of diene, said polymer containing 10 to 80% of ethylene, and being soluble in xylene at ambient temperature;

provided that when one of said heterophasic polymer, said random copolymer having said olefin in excess of 5%, and a combination of said heterophasic polymer and said random copolymer having said olefin in excess of 5% is selected, the polymer material includes it and material selected from the polymers of 1) and 2), and it does not exceed 30% of the polymer material, further provided that when said random copolymer having said olefin in excess of 5% is selected, said polymer material includes said isotactic, propylene homopolymer, and still further provided that the MFR of said polymer material is 5 to 40 g/10 min, and the $\overline{M}w/\overline{M}n$ of said polymer material is from 3 to 6.

* * * * *

UNITED STATES PATENT AND TRADEMARK OFFICE

CERTIFICATE OF CORRECTION

PATENT NO. : 5,529,845

DATED : June 25, 1996

INVENTOR(S) : Millo Branchesi et al.

It is certified that error appears in the above-indentified patent and that said Letters Patent is hereby corrected as shown below:

Title page, item [56] col. 2, under References Cited should read--

--Foreign Application Priority Data
June 17, 1993 [IT] Italy . . . . . MI93A1309--

Signed and Sealed this

Twenty-second Day of October, 1996

Bruce Lehman

*Attest:*

BRUCE LEHMAN

*Attesting Officer*

*Commissioner of Patents and Trademarks*